US006062701A

United States Patent [19]

Hines

[11] Patent Number: 6,062,701

[45] Date of Patent: May 16, 2000

[54] COLLAPSIBLE OUTDOOR LIGHTED CHRISTMAS TREE ENSEMBLE

[75] Inventor: Scott W. Hines, 8718 Christie Ct., Tampa, Fla. 33637

[73] Assignee: Scott W. Hines, Tampa, Fla.

[21] Appl. No.: 09/015,241

[22] Filed: Jan. 29, 1998

Related U.S. Application Data

[63] Continuation of application No. 08/833,795, Apr. 9, 1997.

[51] Int. Cl.[7] ..... F21P 1/02

[52] U.S. Cl. ..... 362/123; 362/252

[58] Field of Search ..... 362/123, 249, 362/252, 806

[56] References Cited

U.S. PATENT DOCUMENTS

| | | | |
|---|---|---|---|
| 3,674,612 | 7/1972 | Gehl, Jr. | 362/123 |
| 4,404,621 | 9/1983 | Mauro | 362/123 |
| 4,968,541 | 11/1990 | McCrory | 362/123 |
| 5,359,502 | 10/1994 | Cantin | 362/123 |

*Primary Examiner*—Vip Patel
*Assistant Examiner*—Todd Reed Hopper

[57] ABSTRACT

A telescoping, outdoor, lighted, Christmas tree exhibit, which at night will simulate a lighted Christmas tree. The Christmas tree exhibit comprises a plurality of concentric hoops, populated with Christmas lights. The hoops are each of decreasing diameter that are sequentially interconnected by a plurality of concentric non stretching, flexible plastic bands, each hoop decreasing in size at the same rate as the hoop before it, with the largest-diameter hoop at the bottom of the Christmas tree exhibit and the smallest-diameter hoop at the top of the Christmas tree exhibit, when fully extended, a conical, tree-shaped appearance is obtained. Preceding the uppermost hoop is a top disk that is connected to the top end of the non stretching, flexible plastic bands. The top disk is supported by an adjustable, collapsible center pole. The bottom end of the non stretching, flexible plastic bands are anchored at the bottom of Christmas tree exhibit, so that when the non stretching, flexible plastic bands are fully extended and pulled taut, the hoops of the tree are completely suspended off the ground and the Christmas tree is standing. The tree is light weight and wind resistant. When disassembled, the hoops rest one inside the other, not touching each other, allowing the lights to stay attached to the hoops while in storage and preventing the breakage of bulbs and entangling of lights, resulting in a quick pop-up installation, and quick disassembly with minimal storage space required.

6 Claims, 3 Drawing Sheets

COLLAPSIBLE OUTDOOR LIGHTED CHRISTMAS TREE ENSEMBLE

This application is a continuation of Ser. No. 08/833,795 filed Apr. 9, 1997.

BACKGROUND OF THE INVENTION

1. Field of the Invention

The present invention relates to an outdoor, artificial Christmas tree populated with Christmas lights on it's frame to simulate a lighted tree at night.

2. Discription of Related Art

The use of the outdoor, artificial Christmas tree has become very popular, but the prior art assembly time is extremely time consuming and does not fit the needs of the consumer especially during the busy Christmas season; and often the storage boxes are very cumbersome. The prior art has many parts to assemble and is (in some cases) made of metals that are heavy and can cause electric shock in the event of an electrical short.

The outdoor, artificial Christmas trees most often are assembled by draping or clipping the lights onto the frame—then, to disassemble the trees the lights need to be removed, which causes entanglement, possible breakage of bulbs, and shortening the life span of each strand of lights, due to so much handling. This all makes for a frustrated time consuming task. For example, U.S. Pat No. 5,488,549 to Mier discloses a light-supporting apparatus with many parts to assemble and disassemble, whose lights are wrapped around the supporting apparatus from top to bottom making the tree a time consuming effort when assembling and disassembling.

The prior outdoor, artificial Christmas trees often resemble trees but only if you are close enough to visually see the material of the frame. At night the trees are (in some cases) a blur, or indistinguishable. The lights are strung in a fashion that is not uniform and at each bulb there is no support to keep within the shape of the tree and (in some cases) the wires are used to support the frame which can cause stress on the wires lights and be a hazard.

The outdoor, artificial Christmas trees most often have many moving parts and/or have many parts that are inserted into each other which can cause wear, become loose, or break from use. Small parts that need to be taken apart and stored can be misplaced. All this can shorten the lifetime use of the trees. For example U.S. Pat No. 3,704,366 to Korb discloses an artificial Christmas tree decoration comprising a skeleton structure of tubular members that have many parts which are inserted into each other and there attached by cotter pins or screws, which may be misplaced or broken.

SUMMARY OF THE INVENTION

My invention is comprised of an outdoor, illuminated decorative Christmas tree apparatus that is constructed to allow the user to put the tree up or down in a matter of minutes, and yet forms a perfect configuration with no entanglement of wires or breakage of bulbs, since the lights do not need to be removed at any time. The invention is a very simple and inexpensive design, made of mostly plastic materials that are light weight and totally weather resistant, with few moving parts (for less wear) and no small parts to detach and possibly misplace. Since the invention is comprised of a non conductive substance it prevents electrical hazards.

The invention is comprised of a series of concentric hoops, populated with Christmas lights. Each hoop is of decreasing diameter which is sequentially interconnected by a plurality of concentric, non stretching, flexible plastic bands. With largest-diameter hoops at the bottom of the tree and smallest-diameter hoops at the top of the tree, a conical tree-shape appearance is obtained when fully extended. Preceding the uppermost hoop of the tree is a disk that is connected to the top end of said non stretching, flexible plastic bands; said disk is supported by an adjustable collapsible center pole. The adjustable, collapsible center pole's threaded stem is inserted and protruding through the center hole of the disk and the star extension is threaded onto said adjustable, collapsible center pole threaded stem and secured with set screw at the bottom end of said star extension. Preceding the last hoop at the bottom of the tree, said non stretching flexible plastic bands are anchored to the ground or other surface. When said non stretching, flexible plastic bands are fully extended and made taut, said concentric hoops of the tree are completely suspended off the ground and tension is formed to said non stretching flexible plastic bands as a downward pressure is created to said adjustable, collapsible center pole allowing tree to stand and restrict high winds. The unique hoop and plastic, wire light fastener design, allows the use of any type of Christmas tree lights.

OBJECT AND ADVANTAGES OF THE INVENTION

The object and advantages of my present invention are to simulate a outdoor lighted Christmas tree that is simple and quick to erect, becomes a perfect configuration, and is simple and quick to take down, no entanglement of wires or breakage of bulbs, and can be stored into a small box.

Another objective is to have minimal handling of lights or wires (less wear and tear on the sets of lights) accomplished by keeping lights attached to the tree frame at all times, including during storage.

Still another objective of the invention is to have few moving parts, less parts to disconnect, (prevents wear) no small parts to remove (avoid loss of parts) and simple and inexpensive to manufacture.

Another objective is to support each light bulb to keep the strands of lights from sagging, preventing visual obstruction by any hoop, allowing to see through the tree structure providing a more full appearance to the tree at any angle, preventing any chance of stress on the lights wires, and to keep an orderly conical shape to the tree so that viewing it at virtually any distance is clearly recognized as a Christmas tree.

Another objective of the present invention is to fasten the light bulbs in an upward position so when the tree is stored into the box the base of the light bulb sockets are resting into the box preventing the bulbs from touching any surface and free from breakage.

A further objective of the present invention is to construct an outdoor, artificial Christmas tree that is light weight, easy to handle, can withstand all types of weather conditions and temperatures, inexpensive to manufacture (with regards to materials and labor) so as to allow a low retail price to the consumer.

A still further objective of the invention of the outdoor, artificial Christmas tree is that the invention can be of a large size and yet store into a thin flat box. For an example: a 10 foot 6 inch tree can store in a box size of 42 inches by 42 inches by 4 inches.

Another objective to the present invention is the unique structure of the hoops to accommodate any Christmas type lights accomplished by the design of the plastic, wire light fastener.

Other characteristics, advantages and objects of this invention can be more readily appreciated from the following description and appended claims. When taken in conjunction with the accompanying drawing, this description becomes part of the specification wherein like references and characters designate corresponding parts in several views.

DESCRIPTION OF THE DRAWINGS

My invention will be better understood and its objectives (other than those set forth above) will become more apparent when consideration is given to the following detailed description thereof. Such description makes reference to the annexed drawings wherein.

DESCRIPTION OF THE PREFERRED EMBODIMENT

The following description is provided to enable any person skilled in the art to construct and use the invention. It sets forth the best modes contemplated by the inventor for carrying out the invention. Various modifications, however, will remain readily apparent to those skilled in the art, since the generic principles of the invention have been defined herein specifically.

Figure 1:
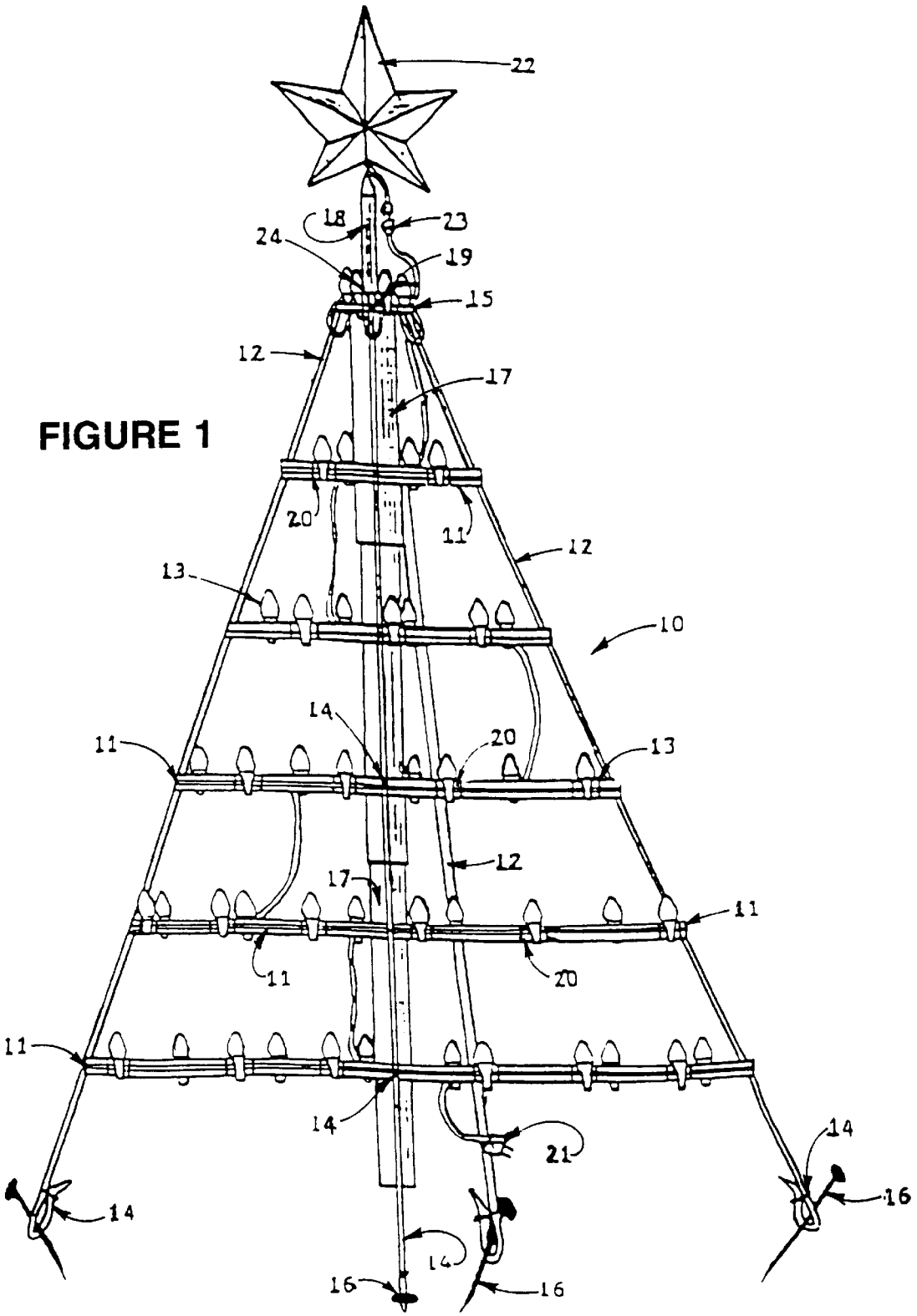
FIG. 1 is a front elevation view of a preferred embodiment of the instant invention.

With reference now to the drawings, and in particular to FIG. 1, thereof the outdoor Christmas light stand embodying the principles and concepts of the present invention and generally designates by the reference numeral 10 will be described. More specifically, it will be noted that the stand device 10 is generally conical in shape and is formed by a plurality of concentric hoops 11 with each of decreasing diameter that are sequentially interconnected by a plurality of concentric, non stretching flexible plastic bands 12 with the largest-diameter hoop 11 at the bottom of stand device 10 and the smallest-diameter hoop 11 at the top of stand device 10. The hoops 11 art formed of a rectangular rigid flat plastic material of approximately three-fourths of an inch in height to support said Christmas light 13 at minimal profile, as such, to keep the hoops 11 from being evident during the day time and virtually invisible at night. Hoops 11 am fastened to a plurality of concentric non stretching, flexible plastic bands 12 with a permanent rivet 14 (as clearly shown in FIG. 5). The non stretching flexible plastic bands 12 are made of a compliant plastic material to allow the hoops 11 to erect from storage and also to flatten for storage. The top end of the non stretching flexible plastic bands 12 are fastened to the disk 15, by a screw 24 (as clearly shown in FIG. 3). The bottom end of the non stretching, flexible plastic bands 12 are looped and are fastened by a rivet 14 to accommodate the stakes 16, which anchor into the ground. Stakes 16 may be replaced by other types of anchors in order to accommodate other types of surf such as, concrete, asphalt, roof tops, or the like. Center pole 17 is of telescoping type to allow easy erection and dismantling of said stand device 10 and also to collapse center pole 17 to a nominal size for storage. The adjustable, collapsible center pole 17 is of telescoping type to allow easy erection and dismantling of said stand device 10 and also to collapse center pole 17 to a nominal size for storage in a box. The adjustable, collapsible center pole 17 is comprised of three tubular members, each member of a larger size of diameter, starting with the smallest diameter of the three members at the bottom allowing for each member to slide over the top of the one before it. This is to prevent moisture or water from contaminating the inner sections of the adjustable, collapsible center pole 17 while the stand device 10 is on display, and exposed to weather conditions. At the top of the adjustable, collapsible center pole 17 is a threaded stem 25 to accommodate the star's extension 18. The threaded stem 25 of the adjustable, collapsible center pole 17 is inserted through the center hole of the disk 15, there as to support the disk 15 for erecting of said stand device 10. After the threaded stem 25 of the adjustable, collapsible center pole 17 is inserted through the disk 15, the stars extension 18 is connected to the threaded stem 25 of the adjustable, collapsible center pole 17 and screwed tight. The set screw 19 is screwed in place to lock the star extension 18 to the threaded stem 25 of the adjustable, collapsible center pole 17, and to prevent from possible loosening of said star extension 18. The base of the star 22 is placed on top of the said star extension 18 and is plugged into the female plug 23 of the lights 13. The star extension 18 is made of a rigid plastic to formed in a cone shape at the top section to accommodate virtually any tree star 22, the middle and bottom section are cylinder shaped with inner threads at the bottom to accommodate said threaded stem 25 of the adjustable, collapsible center pole 17. The string of lights are installed in a fashion, in that, the lights 13 bulbs are facing upward, therefore, allowing the stand device 10 to be lowered and stored so that the bulbs are not touching any surface, this is to prevent from breakage during storage. The lights 13 conventional clip is installed by pushing clip up from the bottom of the said disk 15 into the small holes at the flat surface of the outer perimeter of the said disk 15, starting with the female plug 23 (end of the lights 13). After each hole has been occupied, the remaining lights 13 are dropped down to the first hoop 11 and the light's 13 conventional clip is pushed upwardly onto the bottom edge of said hoop 11, the lights 13 wires are pulled taut around said hoop 11 until the lights 13 have made the full circle of said hoop 11. The balance of lights 13 are dropped down to the next concentric hoop 11 until each hoop 11 is filled in this fashion The lights 13 are usually made up of multiple strings plugged into one another which is conventional with this type of light and then plugged into an external power source (not shown) by electric plug 21. The plastic, wire light fastener 20 is united to the wire lights 13 on either side of it's socket to better secure wires. This plastic, wire light fastener 20 can be used with virtually any Christmas lights.

Figure 2:
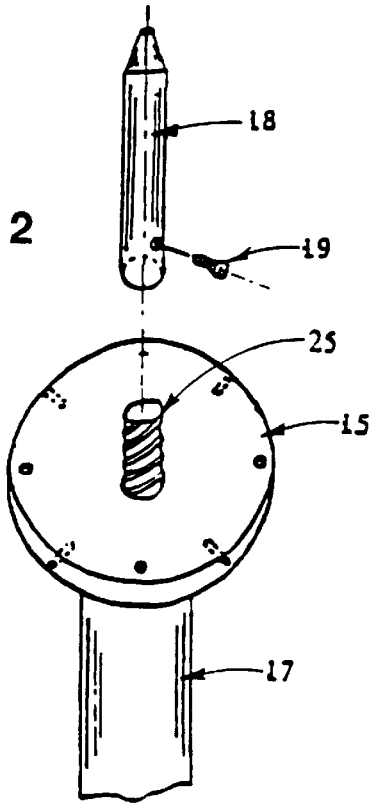
FIG. 2 is a fragmentary exploded view of the adjustable, collapsible center pole supporting the disk and protruding through the disk, the tubular extension with a threaded female end, fitted to threaded stem of said adjustable, collapsible pole, locked with set screw at bottom of tubular extensions base.

FIG. 2 shows an enlarged view of the stars extension 18 being placed onto the threaded stem 25 of the adjustable, collapsible center pole 17, after the disk 15 has been supported by the adjustable, collapsible center pole 17. The star extension 18 is screwed down tight and the set screw 19 is screwed in, to prevent the star extension 18 from loosening. The set screw 19 does not got removed at any time, and is only loosened from the threaded stem 25 of the adjustable, collapsible center pole's 17 shaft for removal of star extension 18.

Figure 3:
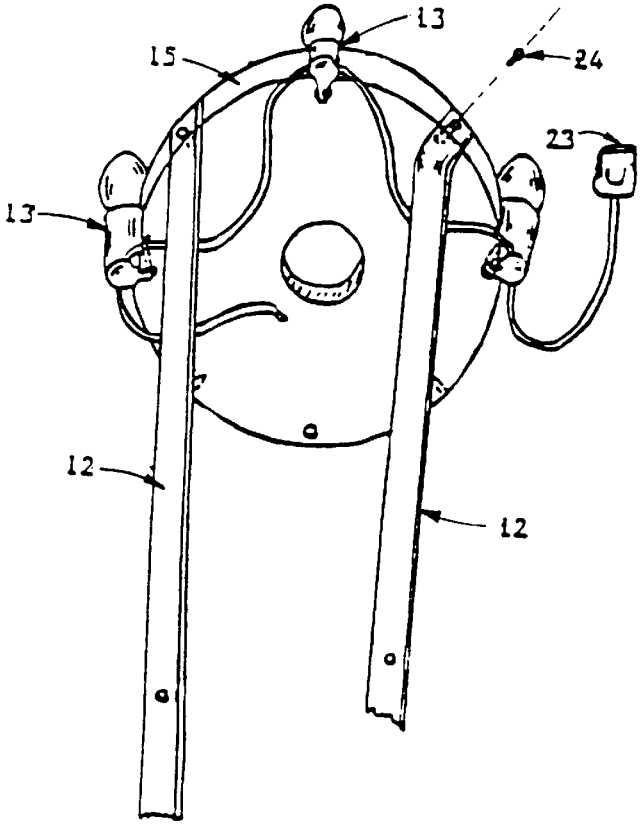
FIG. 3 is a fragmentary exploded view of the disk with several lights in place and with several non stretching, flexible plastic bands connected to the disk.

FIG. 3 is an enlarged view of the disk 15 with a number of the lights 13 and a number of non stretching, flexible plastic bands 12 in place. This detail shows at the non stretching, flexible plastic bands 12 are flexible, and that it is secured by a small screw 24.

Figure 4:
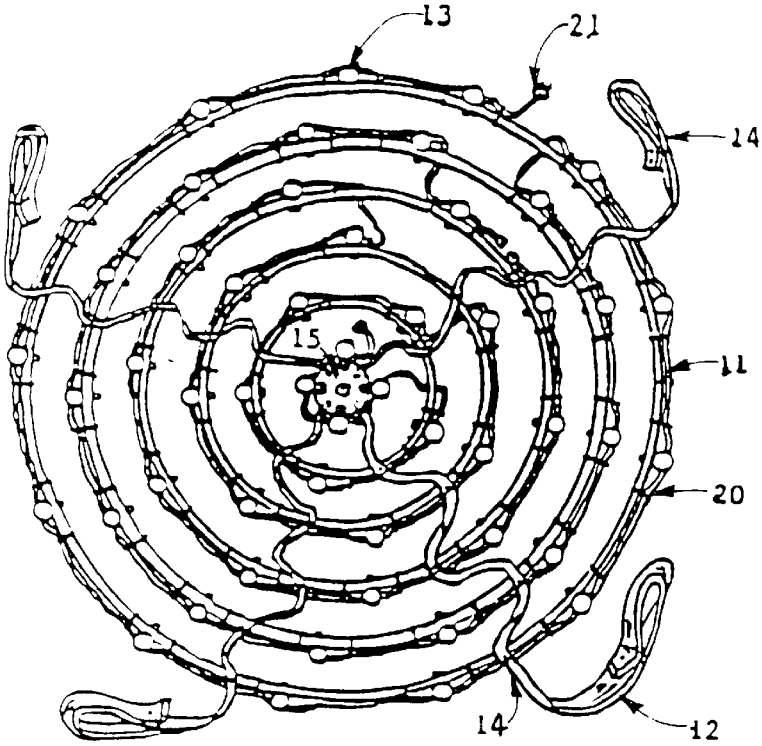
FIG. 4 is a top plain view of the invention in the collapsed state.

FIG. 4 is a top, plain view, of the stand device 10 in the collapsed state for storage. The light stay attached to the hoops 11 and the light's 13 bulbs do not come in contact with any objects or surface thereto prevent breakage and/or entanglement.

Figure 5:
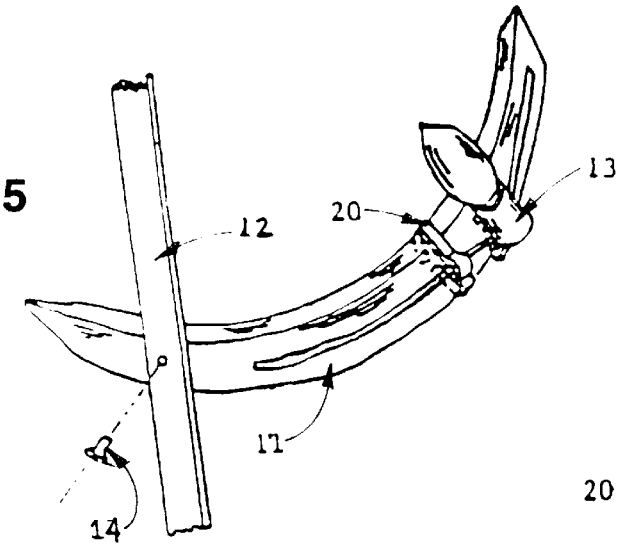
FIG. 5 is a fragmentary exploded view of a non stretching, flexible plastic band attached to a hoop with a light and wire held in place by a plastic, wire light fastener.

FIG. 5 is a partial perspective view of the hoop 11 with a light 13 attached and one plastic, wire light fastener 20 affixed to said light's 13 wire and said hoop 11. This detail shows a non stretching, flexible plastic band 12 fastened to the hoops 11 by a permanent fastener such as a rivet 14.

Figure 6:
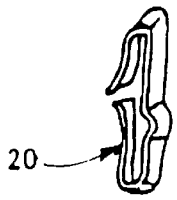
FIG. 6 is an exploded view of the plastic, wire light fastener.

FIG. 6 is an exploded view of plastic, wire light fastener in it's entirety.

The invention has been described in illustrative manner and is to be understood that the wording that has been used is to help to understand the illustration rather then have any limitations. Therefore any modifications and variations of the instant invention are able to be practiced in light of above description.

In respect to the above description, it is to be realized that the choice dimensional relationships for the parts of the invention to be of variations in size, shape, form, materials, functions, and manner of operations, assembly and use, as deemed to one skilled in such art. All equivalent relationships to those that are illustrated in the drawings and described in the specification are to be encompassed by the present invention.

I claim as being new and desired to be protected by Letters Patent of the United States is as follows:

What is claimed is:

1. A collapsible outdoor, lighted Christmas tree ensemble comprising of: a plurality of concentric hoops, formed of a rectangular, rigid flat plastic, each of decreasing diameter that are sequentially interconnected by a plurality of non stretching, flexible plastic bands, with the largest-diameter hoop at the bottom of said tree ensemble; each hoop decreases in size at the same rate as the hoop before to form a conical tree shape appearance; following the upper most hoop attached to the top end of the said non stretching, flexible plastic bands, is a rigid flat, plastic disk; at the bottom end of the said non stretching, flexible plastic bands, is a loop to slide a stake through, for anchoring into the ground; said disk is supported by an adjustable, collapsible center pole and at the top end of said adjustable, collapsible, center pole is a threaded stem that is inserted and protrudes through a center hole of said disk, prior to raising said tree ensemble, a tubular star extension with a threaded female end is fitted to the said adjustable, collapsible center pole's threaded stem, when said adjustable, collapsible center pole is extended the said non stretching flexible bands are pulled taut, suspending said hoops of the tree off the ground to form a conical tree shape, erecting said tree ensemble; Christmas light bulbs or conventional Christmas light clips are inserted with the bulbs pointing upward through a multiple of evenly spaced holes around the outer perimeter of said disk's face, and on each said hoop of said tree ensemble, said Christmas light sockets are attached to said hoop with the bulbs pointing upward in an orderly fashion affixed by plastic, wire light fasteners; therefore when the collapsible center pole is removed from Christmas tree ensemble, said hoops are lowered resting one inside the other, not touching each other and said Christmas lights stay affixed to said hoops and said disk for quick storage and Christmas tree ensemble reset up.

2. An ensemble as in claim 1, wherein, said hoops are formed of a rectangular, rigid, flat, plastic to obtain a small profile of approximately three-fourths of an inch in height and of a dark color to be virtually invisible at night allowing only the said Christmas lights to be noticeable giving the appearance of a lighted Christmas tree at night.

3. An ensemble as in claim 1, wherein, said Christmas lights fasten with said plastic, wire light fastener, in order to allow said Christmas lights socket to rest vertically on the inner or outer face of said hoops, allowing said bulbs to stand upright and above said hoops;

a.) In order for said bulbs to be visible and not obstructed by said hoops at any angle, allowing visibility through said tree ensemble and providing a more full appearance;

b.) Allowing base of said Christmas light socket to rest flat in a storage box, keeping said bulbs from touching any surface to prevent breakage or damage to said bulbs.

4. An ensemble as in claim 1, wherein, said adjustable, collapsible center pole, with a threaded male stem at the top of said adjustable, collapsible center pole, is fitted into the threaded female end of said star tubular extension for stabilizing said star tubular extension.

5. An ensemble as in claim 1, where the star tubular extension end is threaded on the threaded male end of said adjustable, collapsible center pole, raising a tree star or a tree top fixture above said disk and said Christmas lights around said disk, preventing obstruction to said Christmas lights providing a true tree shape appearance.

6. A tree ensemble as in claim 1, wherein, said plastic disk is conformed with a center hole through said plastic disk's flat surface, face for inserting, said threaded male stem of said adjustable, collapsible center pole, and a multiple of evenly spaced holes through the face of said disk's flat surface, around the outer perimeter of said disk to insert said Christmas lights allowing said Christmas lights to be attached in the upright position at top of said tree ensemble and camouflage said disk to be unnoticed at night.

* * * * *